US007392914B2

(12) United States Patent
Sorsa

(10) Patent No.: US 7,392,914 B2
(45) Date of Patent: Jul. 1, 2008

(54) METHOD FOR CONTROLLING SPREADER IN CRANE

(75) Inventor: Timo Sorsa, Jokela (FI)

(73) Assignee: KCI Konecranes PLC, Hyvinkaa (FI)

( * ) Notice: Subject to any disclaimer, the term of this patent is extended or adjusted under 35 U.S.C. 154(b) by 223 days.

(21) Appl. No.: 10/515,052

(22) PCT Filed: Mar. 30, 2004

(86) PCT No.: PCT/FI2004/000189

§ 371 (c)(1),
(2), (4) Date: Nov. 19, 2004

(87) PCT Pub. No.: WO2004/087556

PCT Pub. Date: Oct. 14, 2004

(65) Prior Publication Data

US 2006/0054581 A1 Mar. 16, 2006

(30) Foreign Application Priority Data

Apr. 1, 2003 (FI) ..... 20030486

(51) Int. Cl.
*B66C 13/10* (2006.01)

(52) U.S. Cl. ..... 212/270; 212/274

(58) Field of Classification Search ..... 212/274, 212/270

See application file for complete search history.

(56) References Cited

U.S. PATENT DOCUMENTS 5,769,250 A 6/1998 Jussila et al.

FOREIGN PATENT DOCUMENTS

| | | | |
|---|---|---|---|
| JP | 4-303390 | A | 10/1992 |
| JP | 9-158254 | A | 6/1997 |
| WO | WO-97/08094 | A1 | 3/1997 |
| WO | WO-02/22488 | A1 | 3/2002 |
| WO | WO-02/076873 | A1 | 10/2002 |

*Primary Examiner*—Thomas J. Brahan
(74) *Attorney, Agent, or Firm*—Muncy, Geissler, Olds & Lowe, PLLC

(57) ABSTRACT

The invention relates to a method for controlling swaying and swinging of a spreader in a crane and the load attached thereto, the crane comprising: a trolley, hoist gears, hoisting ropes, on which the spreader is suspended from the trolley, auxiliary gears provided with motors and motor control equipment and auxiliary ropes, and in which method the forces of the auxiliary ropes exerted on the spreader are controlled by moving the auxiliary ropes using the auxiliary gears by means of torque instructions ($T_{control}$) obtained on the basis of the rope forces ($F_{rope}$) of the auxiliary ropes and the rotating speed data of the auxiliary gears, and whereby the rotating speed data of each auxiliary gear is formed gear-specifically as the difference between the measured rotating speed ($n_{act}$) of the auxiliary gear and the calculated rotating speed ($n_{calc}$) of the auxiliary gear.

4 Claims, 3 Drawing Sheets

METHOD FOR CONTROLLING SPREADER IN CRANE

BACKGROUND OF THE INVENTION

The invention relates to a method for controlling swaying and swinging of a spreader in a crane and the load attached thereto, the crane comprising: a trolley, hoist gears provided with hoist drums placed in the trolley, hoisting ropes arranged on the hoist drums, on which the spreader is suspended from the trolley and which are directed back to the trolley through sheaves arranged on the spreader, whereby the swaying and swinging is controlled by control equipment comprising: four auxiliary gears provided with rope drums including motors and motor control equipment placed in the trolley, auxiliary ropes arranged on the rope drums of the auxiliary gears, sheaves for the auxiliary ropes placed in the spreader, through which sheaves the auxiliary ropes passing obliquely from the rope drums of the auxiliary gears are directed to spaces arranged in the hoist drums for the auxiliary ropes, and in which method the forces of the auxiliary ropes exerted on the spreader are controlled by moving the auxiliary ropes using the auxiliary gears by means of torque instructions obtained on the basis of the rope forces of the auxiliary ropes and the rotating speed data of the auxiliary gears using control logic that allows providing and maintaining the desired rope forces, controls the rotation and the resistance of the swinging of the motors in the auxiliary gears.

The method of the invention is known from FI patent 101466, in which the method is presented in connection with a crane moving by means of rubber tyres and whose hoisting heights and hoisting speeds are moderate.

The method according to FI patent 101466 adequately reduces the undesired movements of the load in the original applications thereof. Then again, in for instance the quay cranes moving on rails presented in FI patent 108788, whose hoisting heights and moving speeds are significantly higher, the diagonal geometry of the auxiliary ropes and situations, in which the changes of the course and the malfunction associated with the hoisting motion require very rapid speed changes in the auxiliary gears that are appropriate in all situations, the method presented in FI patent 101466 provides incorrect rotating speed data for controlling the auxiliary gears.

BRIEF DESCRIPTION OF THE INVENTION

It is an object of the present invention to solve the problem presented above. This object is achieved with the method according to the invention, which is mainly characterized in that an control logic circuit is supplied with a speed instruction as the rotating speed data of the auxiliary gear that is formed gear-specifically as the difference between the measured rotating speed of the auxiliary gear and the calculated rotating speed of the auxiliary gear.

The calculated rotating speed comprises at least the calculated rotating speed of the auxiliary gear caused by the diagonal geometry of the auxiliary ropes.

If the auxiliary ropes are wound on a hoist drum in several layers, then the calculated rotating speed of the auxiliary gear caused by the possible layer shift of the auxiliary rope occurring on the hoist drum is added to the calculated rotating speed.

What is preferably also added to the calculated rotating speed is the calculated rotating speed of the auxiliary gear caused by the sway of the spreader occurring about an axis that is parallel with the hoist drum axes, especially when such sways are carried out by the driving movements of what are known as "list-gears".

It is also appropriate that the calculated rotating speed of the auxiliary gear deviating the spreader from the parallel horizontal line of the hoist drums caused by the possible varying hoisting speed (especially the "trim drive" performed on purpose) of the hoisting gears is added to the calculated rotating speed.

The method according to the invention allows removing the rough and jerky correcting movements of the spreader and the load from the cranes built for high speeds and hoisting heights, which have made the use of the method known from FI patent 101466 impossible as such.

The details of the invention and the advantages thereof will be described in the following detailed description of the invention.

BRIEF DESCRIPTION OF THE DRAWINGS

In the following, the method according to the invention will be explained in greater detail by means of a crane arrangement, in which the method can be successfully applied with reference to the accompanying drawings, in which.

DETAILED DESCRIPTION OF THE INVENTION

Figure 1:
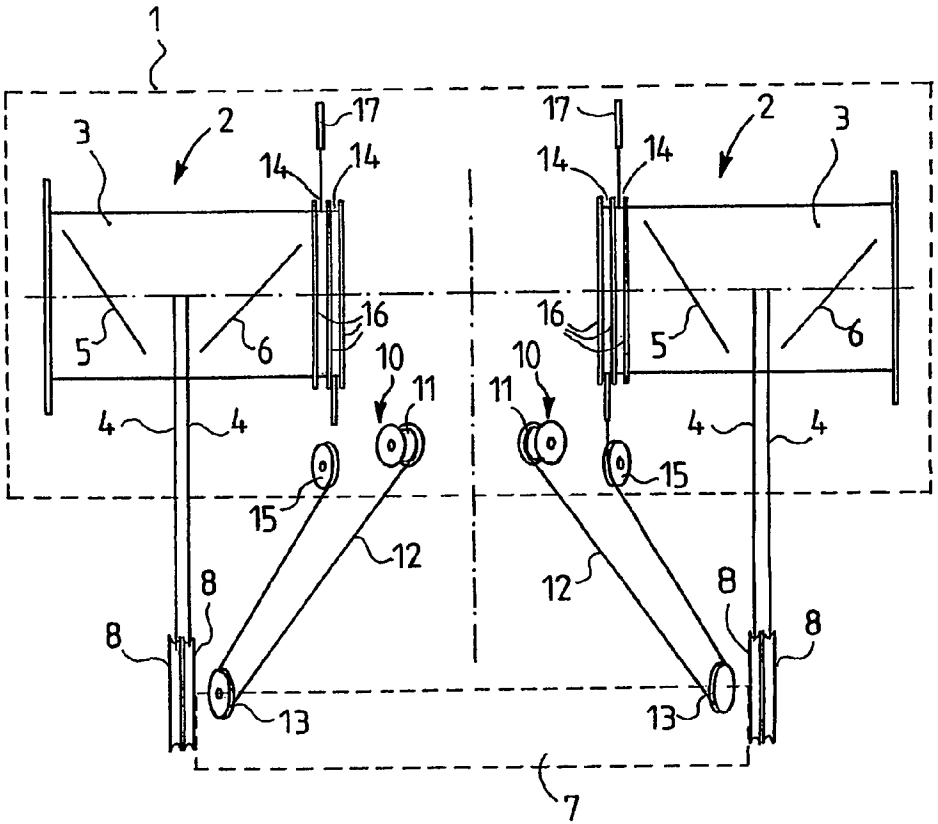
FIG. 1 shows a simplified schematic view of a crane arrangement seen from the travel direction of a trolley.

The crane arrangement shown in the drawings, known for instance from FI patent 108788, comprises two hoist gears 2 with hoist drums 3 placed in a crane trolley 1. These elements are arranged in the trolley 1 such that the longitudinal axes thereof are in the same line A. Two hoisting ropes 4 are arranged in parallel on the hoist drum 3 of both hoist gears 2 so that grooves 5 and 6 reserved for the ropes on the surface of the hoist drum 3 are opposite in direction. A spreader 7 for fastening a load to be hoisted (not shown) is suspended on the hoisting ropes 4. The spreader is provided with sheaves 8 for the hoisting ropes 4, through which the hoisting ropes 4 are directed back to the trolley 1. The sheaves 8 are placed in the spreader 7 substantially directly below the longitudinal middle points of the hoist drums 3, whereby the position of the hoisting ropes remains substantially symmetrical in the vertical direction despite the different hoisting heights. The hoisting ropes 4 are directed to the trolley 1 through additional sheaves 9 and secured to the crane through possible overload protections (not shown).

Figure 2:
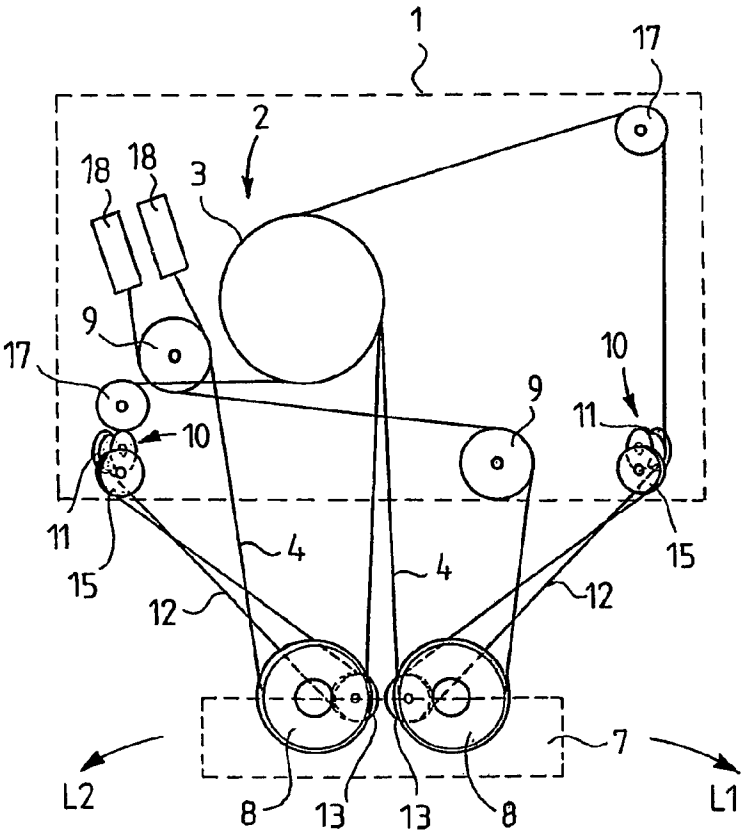
FIG. 2 is a side view of the arrangement shown in FIG. 1.
Figure 4:
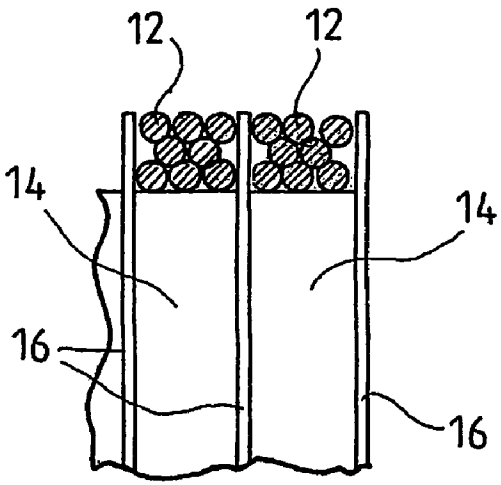
FIG. 4 shows enlarged auxiliary rope spaces.
Figure 3:
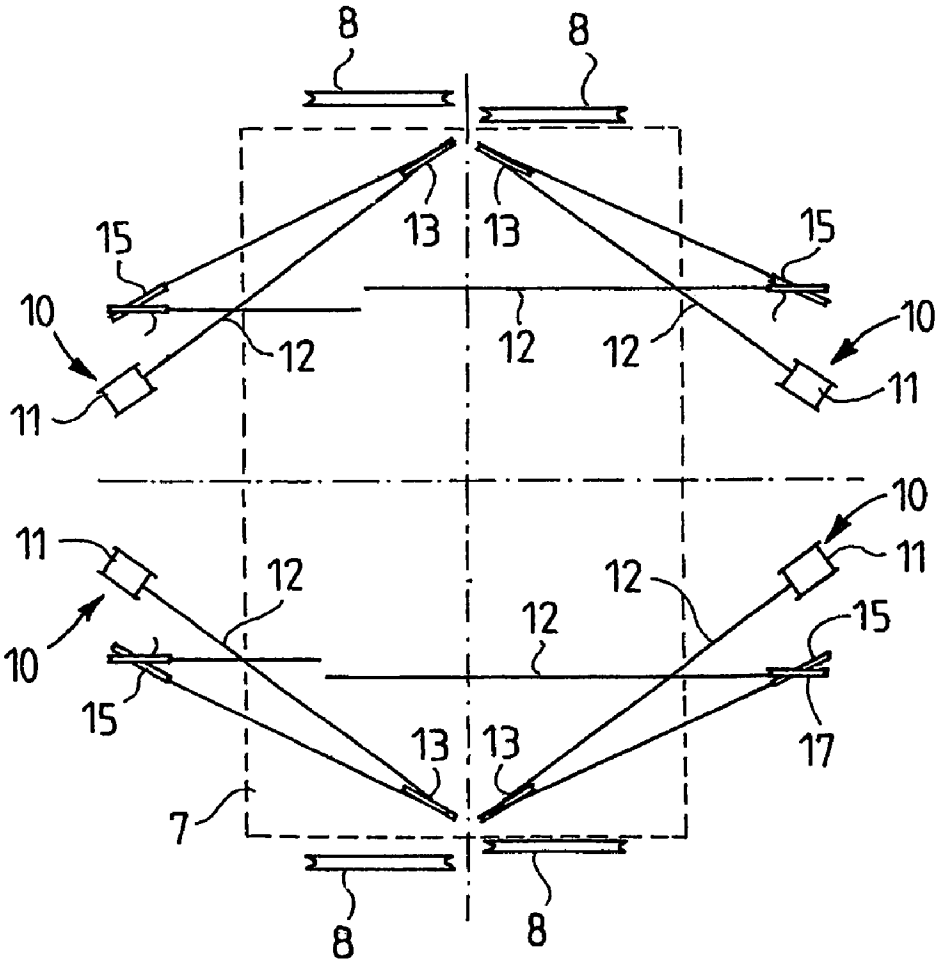
FIG. 3 is a top view of the arrangement shown in FIG. 1.

In this example the hoisting ropes 4 are also fastened to the fastening points thereof by means of what are known as list gears 18, one such list gear being provided for two hoisting ropes 4, in other words the number of list gears is two in this crane. These gears 18 are used to list the spreader 7 forwards or backwards in accordance with arrows L1 and L2 shown in FIG. 2. Such list gears 18 are known as such, and will therefore not be explained in more detail in this context.

The arrangement also comprises four auxiliary gears 10 placed in the trolley 1 for controlling swaying and swinging of the spreader 7 and the load attached thereto. Preferably, the auxiliary gears 10 are arranged in a rectangle (although an asymmetrical arrangement is also possible) so that one auxiliary gear 10 is located in each corner of the rectangle. A rope drum 11 of each auxiliary gear 10 is provided with an auxiliary rope 12 that passes obliquely into sheaves 13 located in the spreader 7 and through them back towards the hoist drums 3 and into spaces 14, which are preferably designed and reserved for them in the hoist drums 3. The sheaves 13 are also preferably arranged in a rectangle so that one sheave 13 is located in each corner of the rectangle. It is necessary to arrange the auxiliary ropes 12 obliquely in order that the vertical forces required to prevent or reduce swaying or swinging could be exerted on the spreader 7 and the load by means of the auxiliary gears 12 and the auxiliary ropes. Consequently, the hoisting ropes 4 can also be positioned completely vertically. The control of such swaying and swinging will be described below.

The auxiliary ropes 12 are preferably provided with at least one set of additional sheaves 15 arranged in the trolley 1, through which sheaves the auxiliary ropes 12 arriving from the spreader 7 and the first set of sheaves 13 therein is directed to auxiliary rope spaces 14 of the hoist drums 3. Thus, each auxiliary rope 12 is provided with a stationary point in the trolley 1 relative thereto and independent of the hoisting height, whereby the movement of the auxiliary ropes 12 in relation to the drum on the side of the trolley 1 is avoided. In addition, the spaces 14 for the auxiliary ropes are formed at the ends of the hoist drums 3 within a considerably narrow area, for instance by means of flanges 16, so that the auxiliary ropes 12 can be wound onto a plurality of layers, in which case the angle of the auxiliary ropes 12 in relation to the hoist drum 3 remains almost constant at any hoisting height, and the hoist drum 3 is made considerably shorter than previously.

What is further arranged between the additional sheaves 15 and the hoist drums 3 are sheaves 17, through which the auxiliary ropes 12 pass, but these are mainly arranged to ensure an unobstructed passage for the auxiliary ropes 12.

In accordance with FI patent 101466, the auxiliary gears 10 can be, for instance, identical, mechanically independent systems, the control of which is implemented totally electrically and determined on the basis of the weighting data of the auxiliary rope 12, the rotating speed of the rope drum 11 i.e. the auxiliary gear 10, and similar variables. A sufficient amount of auxiliary rope 12 is always stored on the rope drum 11, and thereby the compensation created by different geometries of the auxiliary ropes 12 and the hoist ropes 4 will be automatically solved. By means of a specific control logic C controlling each auxiliary gear 10, the forces exerted on each auxiliary rope 12 are controlled on the basis of the above-mentioned variables in such a manner that the spreader 7 and the load suspended thereto are not allowed to sway or swing. It is not necessary to place the auxiliary gears 10 totally symmetrically, since the above-mentioned control logic is able to take into account the asymmetry, if it is known in advance.

Figure 5:
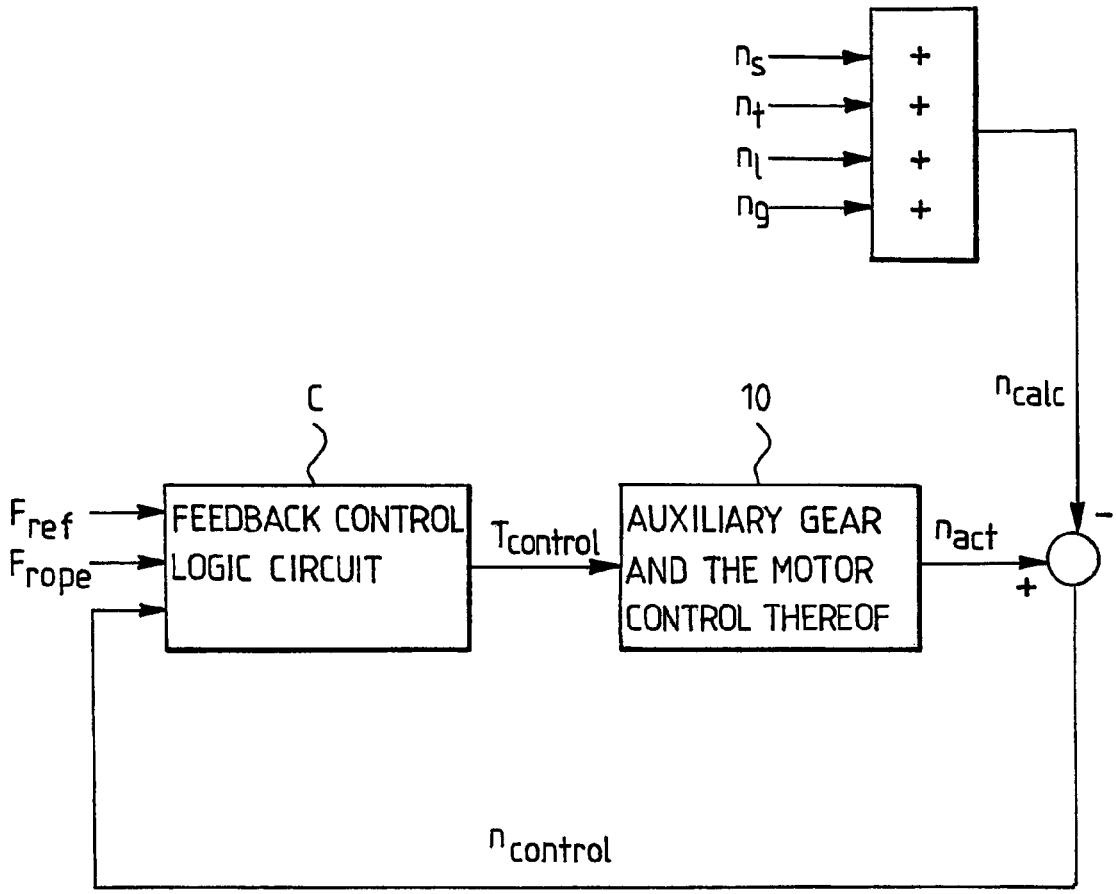
FIG. 5 shows a simplified diagram of a method according to the invention.

Referring now to FIG. 5, the movements of the spreader 7 and the load attached thereto are controlled in accordance with the invention as follows.

A torque instruction $T_{control}$ is calculated for each auxiliary gear 10 by means of a separately arranged control logic circuit C, which may, for instance, refer to a circuit known from FI patent 101466 comprising a force controller and a speed controller, in which the torque instruction $T_{control}$ is calculated on the basis of the reference value $F_{ref}$ of the rope force in each auxiliary gear 10, the measuring data of the rope force $F_{rope}$ and the rotating speed n of the auxiliary gear 10. The rope force $F_{rope}$ may represent a piece of information measured by means of an appropriate weighing sensor or the rope force can be calculated from the actual value of the torque determined by the motor control equipment (for example a frequency converter) in the auxiliary gear 10. The rotating speed data shows, in turn, how the load sways from the position of equilibrium thereof. Setting the reference value $F_{ref}$ of the rope force is described in detail in the above-mentioned patent and will therefore not be described in more detail in this context.

In accordance with the invention, $n_{control}$ obtained as a difference between the measured rotating speed $n_{act}$ of the auxiliary gear 10 and the calculated rotating speed $n_{calc}$ of the auxiliary gear 10 is supplied as the rotating speed data n of the auxiliary gear 10 to the feedback control logic circuit C.

In this example the calculated rotating speed $n_{calc}$ comprises at least the calculated rotating speed $n_g$ of the auxiliary gear 10 caused by the diagonal geometry of the auxiliary ropes 12 and the calculated rotating speed $n_l$ of the auxiliary gear 10 caused by the layer change of the the auxiliary rope 12 occurring on the hoist drum 2.

Let us presume that the hoisting ropes 4 are vertically positioned and the auxiliary ropes 12 are placed symmetrically, then:

$$n_g = a3 * \left( \frac{a1 - H}{\sqrt{(a1 - H)^2 + a2^2}} - 1 \right) * dH, \text{ where}$$

a1=a vertical geometry parameter of the auxiliary rope 12 (a1-H is the vertical projection of the diagonal part of the auxiliary rope 12), a2=a horizontal geometry parameter of the auxiliary rope 12 (the horizontal projection of the diagonal part of the auxiliary rope), a3=a scale factor H=hoisting height of the spreader 7, and dH=hoisting speed of the spreader 7.

As a result of the layers formed on the auxiliary rope 12, the winding beam thereof changes, whereas it remains the same in the hoisting ropes 4. Consequently, a need arises to present the following compensation, whereby the rotating speed associated with the layer change of the auxiliary rope 12 is calculated in accordance with the following formula:

$$n_l = k \times dH, \text{ where}$$

k=a constant conversion factor, the value of which changes stepwise as a function of the hoisting height always when the auxiliary rope 12 moves from one layer to another on the hoist drum 3, and dH=hoisting speed of the spreader (7).

If the auxiliary gears 12 are asymmetrically placed, each gear is provided with an $n_g$ of different magnitude owing to the gear-specific change of the geometry parameter a2.

As the above-mentioned list gears 18 are used to list the spreader 7 forwards or backwards, in other words the spreader is listed together with the axes of the hoist drums 3 about a parallel axis in directions L1 or L2, then the calculated list rotating speed $n_s$ of the auxiliary gear is added to the calculated rotating speed $n_{calc}$.

If the hoisting gears 2 are driven at different speeds in what is known as the trim drive with the idea that the spreader 7 is placed slightly obliquely, in other words the spreader 7 is deviated from the horizontal line that is parallel with the hoist drums 3, whereby the calculated trim rotating speed $n_t$ of the auxiliary gear is further added to the calculated speed $n_{calc}$.

The specification of the above invention is merely intended to illustrate the method according to the invention by means of one preferable embodiment. However, a person skilled in the art is able to apply the method in a broader sense within the scope of the appended claims. Therefore, the same method can even be used with the crane shown in FI patent 101466, even though the load thereof is adequately controlled by means of the previously known method. Numerous practical alternatives exist for implementing the details of the method that are incorporated within the scope of the invention defined in the claims.

The invention claimed is:

1. A method for controlling swaying and swinging of a spreader in a crane and the load attached thereto, the crane comprising:

a trolley, hoist gears provided with hoist drums placed in the trolley, hoisting ropes arranged on the hoist drums, on which the spreader is suspended from the trolley and which are directed back to the trolley through sheaves arranged on the spreader, the swaying and swinging being controlled by control equipment comprising:

four auxiliary gears provided with rope drums and including motors and motor control equipment placed in the trolley, auxiliary ropes arranged on the rope drums of the auxiliary gears, sheaves for the auxiliary ropes placed in the spreader, through which sheaves the auxiliary ropes passing obliquely from the rope drums of the auxiliary gears are directed to spaces arranged in the hoist drums for the auxiliary ropes, said method comprising:

controlling forces exerted on the spreader by each auxiliary rope driven by a corresponding auxiliary gear based on torque instructions;

determining said torque instructions by means of control logic which receives force data of the corresponding auxiliary rope and rotating speed data of the corresponding auxiliary gear, said control logic providing and maintaining the desired rope forces, controlling the rotation and the resistance of the swinging of the spreader using said motor in the corresponding auxiliary gear;

supplying the control logic with rotating speed data of the corresponding auxiliary gear equal to a difference between a measured rotating speed of the corresponding auxiliary gear and a calculated rotating speed of the corresponding auxiliary gear;

determining the calculated rotating speed based on at least the calculated rotating speed $n_g$ of the auxiliary gear caused by the diagonal geometry of the auxiliary ropes, where the hoisting ropes are vertically positioned and the auxiliary ropes are placed symmetrically, and where $$n_g = a3 * \left( \frac{a1 - H}{\sqrt{(a1 - H)^2 + a2^2}} - 1 \right) * dH, \text{ where}$$

a1=a vertical geometry parameter of the auxiliary rope, and a1 −H is the vertical projection of the diagonal part of the auxiliary rope, a2=a horizontal geometry parameter of the auxiliary rope, the horizontal projection of the diagonal part of the auxiliary rope, a3=a scale factor H=hoisting height of the spreader, and dH=hoisting speed of the spreader.

2. A method as claimed in claim 1, wherein a calculated rotating speed $n_1$ of the auxiliary gear caused by the layer change of the auxiliary rope occurring on the hoist drum is added to the calculated rotating speed, whereby $n_1$=k×dH, where k=a constant conversion factor, the value of which changes stepwise as a function of the hoisting height always when the auxiliary rope moves from one layer to another on the hoist drum, and dH =hoisting speed of the spreader.

3. A method as claimed in claim 1 wherein a calculated rotating speed of the auxiliary gear caused by the listing or sway of the spreader occurring about an axis that is parallel with the axes of the hoist drums is added to the calculated rotating speed.

4. A method as claimed in claim 1 wherein a calculated rotating speed of the auxiliary gear deviating the spreader from the horizontal line that is parallel with the hoist drums caused by the different hoisting speed of the hoist gears is added to the calculated rotating speed.

* * * * *